US005695368A

United States Patent [19]

Joly et al.

[11] Patent Number: 5,695,368

[45] Date of Patent: Dec. 9, 1997

[54] ELECTRICAL TERMINAL WITH PROTECTED LOCKING LANCE AND A CONNECTOR THEREFOR

[75] Inventors: Jean Claude Joly, Osny; Jean-Pierre Picaud, Eaubonne; Patrick Mansutti, Cergy, all of France

[73] Assignee: The Whitaker Corporation, Wilmington, Del.

[21] Appl. No.: 740,063

[22] Filed: Oct. 24, 1996

[30] Foreign Application Priority Data

Nov. 14, 1995 [FR] France ..... 95 13465

[51] Int. Cl.[6] ..... H01R 9/09

[52] U.S. Cl. ..... 439/748; 439/839

[58] Field of Search ..... 439/746–749, 439/839, 843, 846

[56] References Cited

U.S. PATENT DOCUMENTS

| | | | |
|---|---|---|---|
| 3,550,067 | 12/1970 | Hansen | 439/748 |
| 5,266,056 | 11/1993 | Baderschneider et al. | 439/746 |
| 5,613,885 | 3/1997 | Plate et al. | 439/843 |

FOREIGN PATENT DOCUMENTS

| | | | |
|---|---|---|---|
| 0 352 966 B1 | 1/1990 | European Pat. Off. | H01R 4/24 |
| 41 31 470 C2 | 4/1993 | Germany | H01R 13/434 |

*Primary Examiner*—Gary F. Paumen
*Assistant Examiner*—Christopher Goins

[57] ABSTRACT

An electrical connector assembly comprises terminals having an inner body and an outer body. The inner body is provided with cantilever beam locking lances that are positioned in slots of the outer body. The outer body thus protects the locking lance from catching onto foreign objects. This is particularly advantageous for insertion and retraction through a sealing member. The slot may also provide polarization of the terminal in a connector housing cavity.

5 Claims, 3 Drawing Sheets

ELECTRICAL TERMINAL WITH PROTECTED LOCKING LANCE AND A CONNECTOR THEREFOR

BACKGROUND OF THE INVENTION

1. Field of the Invention

This invention relates to an electrical terminal having a locking lance that is protected, and an electrical connector therefor.

2. Description of the Prior Art

It is known to provide stamped and formed electrical terminals with resilient locking lances for retention in a connector housing. Some terminals are provided with locking lance protection, such as bulges on either side of the locking lance that prevent entanglement of foreign objects beneath the locking lance. Certain terminals are for insertion in connectors having elastomeric seals. Extraction of the terminals often damages the seal member or terminal due to the locking lance that is outwardly biased. It is however sometimes necessary to remove terminals for repair or replacement.

It is desirable to provide a terminal that can be made in a more compact manner and has a more reliable locking lance protection system than those found in the Prior Art. In particular, the terminal should be adapted for easy extraction through a seal without damage. It is also desirable to provide electrical connectors with terminals that are very compact and incorporate a multitude of functions, namely locking lance protection, polarization of the terminal in a housing cavity, and protection of the terminal contact body.

SUMMARY OF THE INVENTION

It is therefore an object of this invention to provide an electrical terminal that is compact, cost-effective, reliable and well protected.

It is a further object of this invention to provide an electrical connector with electrical terminals that are robust, well protected, and allow easy extraction through a seal.

It would be further advantageous to provide a terminal that has a locking lance protection and means for polarizing the terminal within a housing cavity in a compact manner.

Objects of this invention have been achieved by providing an electrical terminal and a connector assembly therefor, the terminal having a connection section for connection to conducting wires, a body section, and a contact section, the body section having a substantially box-shaped inner body and an outer body mounted therearound, the inner body having a resilient locking lance, and the outer body having a longitudinal slot extending in the mating direction of the terminal and providing a recess within which the locking lance is positioned, the slot extending from a mating end of the terminal to a position proximate the connection end. Advantageously therefore, positioning of the locking lance within the slot provides reliable protection thereof from external objects. Furthermore, the slot can act as a polarizing member for correct orientation of the terminal within a connector housing by cooperation with a retention protrusion engageable with the locking lance, the protrusion positioned in a cavity of a connector housing. The outer body can be a separate body of a more resilient material than the inner contact body and having spring support members for contact arms of a receptacle terminal. The outer body can also be made to wrap around the mating end of the inner contact body, in the case of a receptacle terminal, and be provided with a cavity at the mating end for receiving a complementary pin terminal therethrough. In this way the terminal is well protected due to provision of the locking lance within the slot such that the whole locking lance is positioned within a recess of the outer profile of the contact which can thus be extracted through an elastomeric seal without sharp edges thereof touching the seal.

Further advantageous features of the invention will be apparent from the following description, drawings and claims.

DETAILED DESCRIPTION OF THE PREFERRED EMBODIMENT

Figure 1:
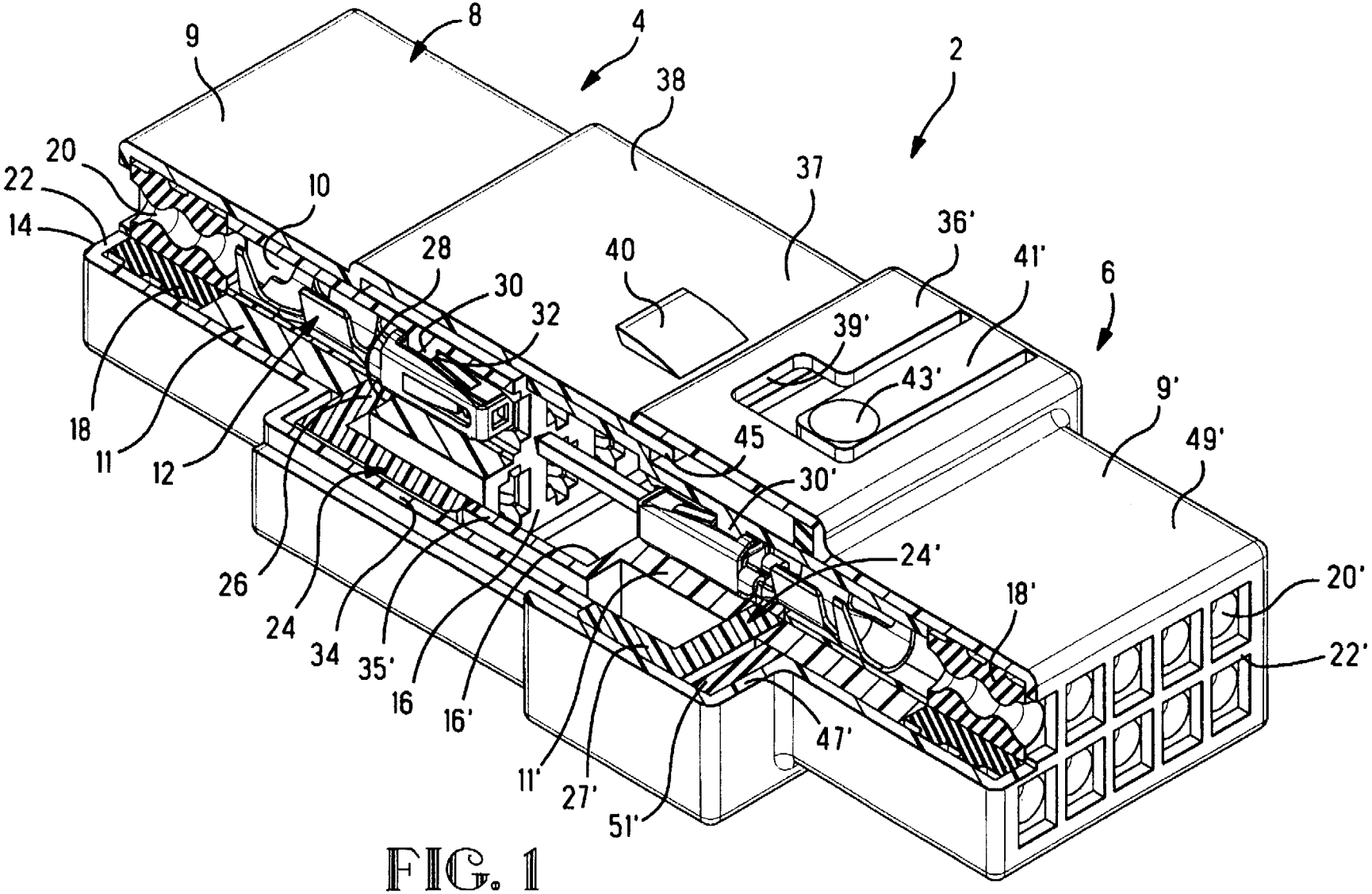
FIG. 1. is a partial cross-sectional view in three dimensional perspective of mating female and male connector assemblies according to this invention.

Referring first to FIG. 1, an electrical connector assembly 2 comprises a female connector 4 and a male connector 6. The female connector 4 comprises an insulative housing 8 having an outer housing 9 and inner housing 11 with a plurality of cavities 10 extending therethrough for receiving receptacle terminals 12. The cavities 10 extend from a terminal receiving end 14 to a mating end 16. At the terminal receiving end is positioned an elastomeric seal 18 comprising a single integral body having a plurality of holes 20 extending therethrough for tightly receiving conductors crimped to the terminals 12. The outer housing 9 has an end wall 22 at the terminal receiving end 16 against which the seal 18 is mounted. The seal is assembled into the outer housing 8 from the mating end 16 until abutment with the end wall 22. The female connector 4 further comprises a secondary locking member 24 having an axial extension (27) extending towards the mating end 16, and orthogonal thereto a plate 26 with holes extending therethrough for receiving the terminals 12. The plate 26 is slidably received in a slot 28 traversing the inner housing 11. The secondary locking member 24 can be positioned in a preassembly position where terminals can be received into the cavities until retention therein by engagement of locking lances of the terminals with shoulders of the housing, the secondary locking member then movable into a fully locked position whereby shoulders of the sliding plate 26 engage behind shoulders of the terminals, thereby providing secondary retention thereof.

Within the terminal receiving cavities 10 are locking projections 30 that project from top and bottom walls of the cavities, and have locking shoulder 32.

The male connector 6 comprises many similar features to that of the female connector 4, these similar features being denoted with the same number as that described for the female connector, but with a prime. The similar features will not be further described, as their function and structure is similar to that already described for the female connector.

The outer housing 9 of the female connector 4 comprises an extension 34 extending beyond the mating end 16 and abuttable against the axial extension 27' of the secondary locking member 24' of the male connector, when the secondary locking member is in the preassembly position. Once the secondary locking member 24' has been slid to the fully locked position, the extension 34 can be slid past and adjacent the secondary locking member extension 27' allowing coupling of the parts. The male connector 6 also comprises a similar feature, having an extension 35' extending from the inner body and abuttable against the extension 27 of the secondary locking member 24 of the female connector when in the preassembly position. Disengagement of the abutting members occurs when the secondary locking member is moved to the fully locked position. The latter features thus ensure that male and female connectors can only be coupled when all the terminals are fully locked in their respective cavities, and the secondary locking members are in the fully locked position.

The male connector comprises an outer housing 9' and an inner housing 11'. The outer housing 9' has an enlargened shroud portion 36' at the mating end 16', and a smaller terminal receiving end portion surrounding the inner housing. The male connector shroud portion 36' receives an outer shroud 37 of the female connector therein when the connectors are coupled. The male connector shroud 36' forms a shoulder 47' with the terminal receiving end portion 49', against which an elastomeric seal 51' is mounted within the outer housing. The shroud 37 of the female connector abuts the seal 51' when the connectors are mated for sealing therebetween. On a top wall 38 of the female connector shroud 37, is a locking protrusion 40 proximate a leading end 45 of the outer housing 11, engageable behind a locking shoulder 39' of the outer shroud 36' of the male connector. A resilient cantilever beam release latch 41' is cut out of the shroud 36' and positioned adjacent the locking shoulder 39'. A free end 43' of the resilient release member 41' can be depressed in order to inwardly bias the leading end 45 of the female connector outer housing 9 in order to depress the protrusion 40 below the locking shoulder 39' for releasing the female and male connectors. A compact connector latching mechanism is thus achieved.

Figure 2:
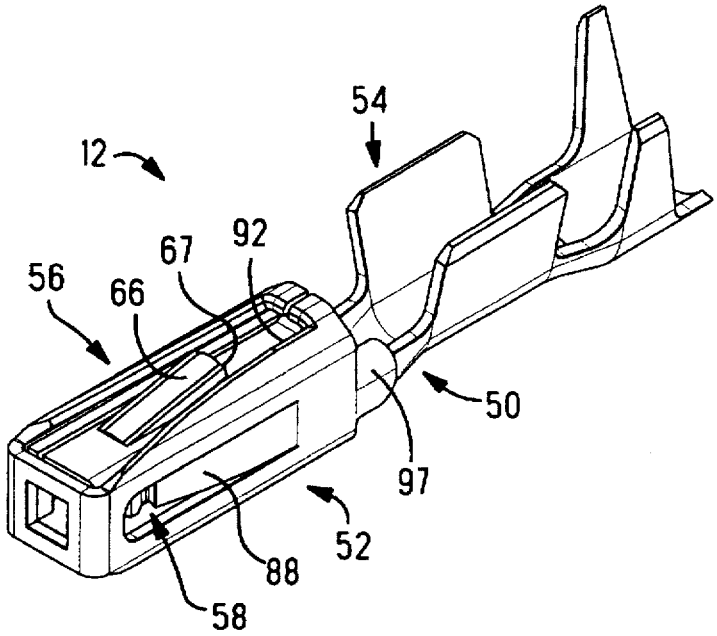
FIG. 2 is an isometric view of a receptacle terminal of a female connector according to this invention.
Figure 3:
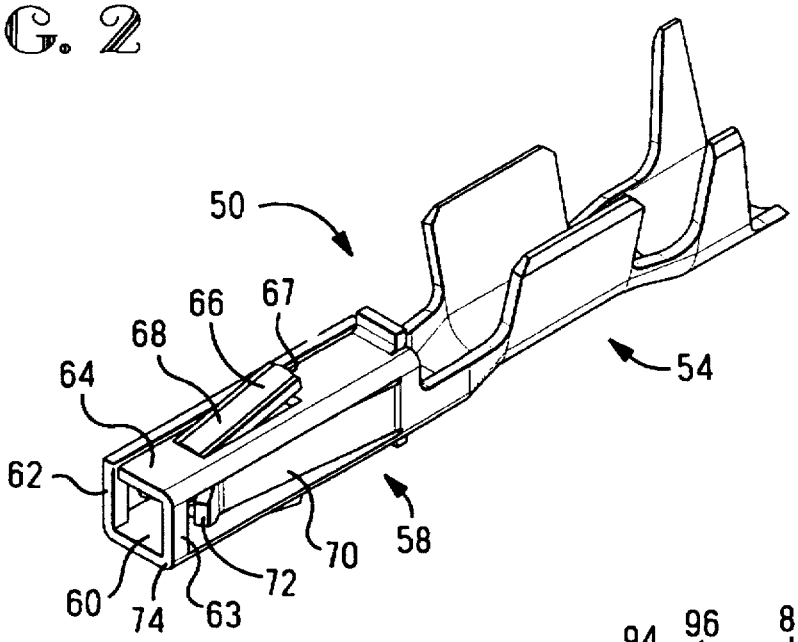
FIG. 3 is an isometric view of an inner contact body of the terminal of FIG. 2.

Referring now to FIG. 2, the receptacle terminal of the female connector will now be described. The receptacle terminal 12 comprises a stamped and formed inner body 50 and an outer body 52. The terminal comprises a connection section 54 for connection to a conducting wire, a body section 56 and a contact section 58. Referring to FIG. 3, the body section 56 of the inner body is substantially box-shaped and comprises a bottom wall 60, side walls 62, 63 extending from lateral edges of the bottom wall 60, and a top wall 64 opposed to the bottom wall 60. Both the top and bottom walls 60, 64 have locking lances 66 stamped obliquely outwardly therefrom. The locking lances 66 are provided with a central rib 68 for bending reinforcement thereof. The contact section 58 of the inner contact body comprises cantilever beam contact arms 70 stamped out from the side walls 62, 63 and attached proximate the connection section 54, extending to free ends 72 proximate a mating end 74 of the terminal.

Figure 4:
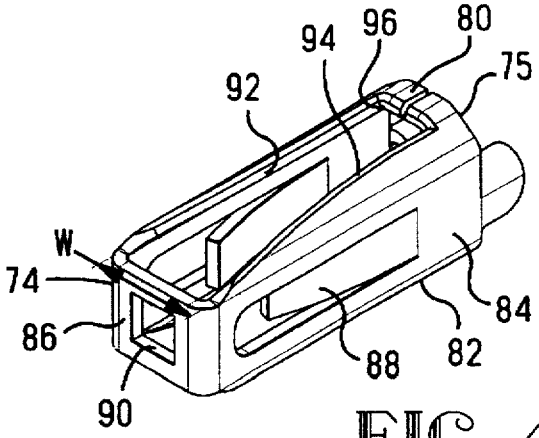
FIG. 4 is an isometric view of the outer body of the terminal of FIG. 2.
Figure 5:
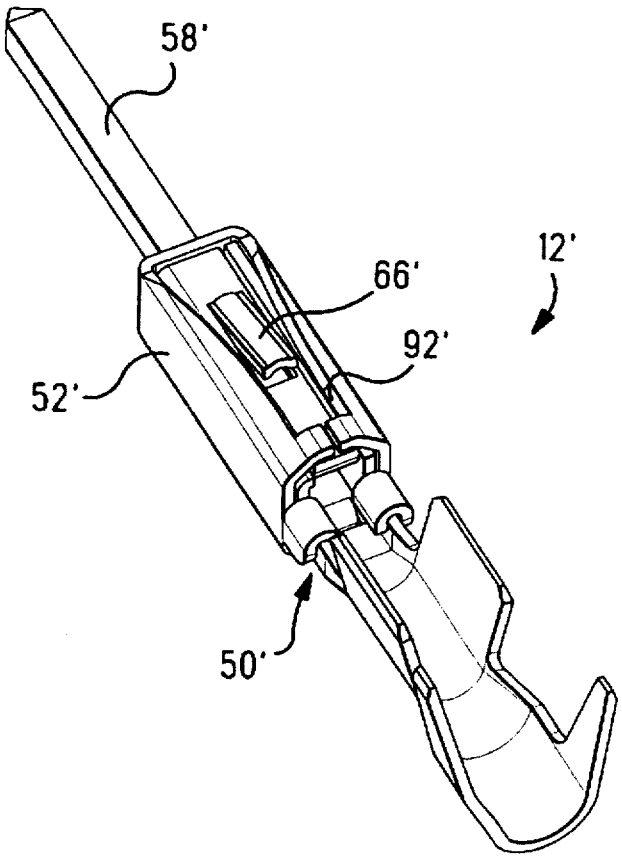
FIG. 5 is an isometric view of a male terminal of the male connector of FIG. 1.

Referring now to FIG. 4, the outer body 52 is stamped and formed from a resilient spring metal such as stainless steel, having a substantially box-shape with a top wall 80, bottom wall 82, side walls 84 and a front wall 86. The side walls 84 have inwardly biased cantilever beam spring arms 88 that are resiliently biasable against the contact arms 70 of the inner contact body, for increasing the contact pressure of the contact arms. The front end 86 comprises a cut-out 90 to enable passage of a mating pin terminal therethrough for insertion between the contact arms 70 of the inner contact body. Top and bottom walls 80 comprise each a slot 92 extending from the mating end 74 to a rear end 75 proximate the connection end of the terminal. The width W of the slot proximate the mating end 74 is large, and extends substantially from side wall to side wall 84, the slot 92 tapering inwardly therefrom to an intermediate section 94 where it then extends with a substantially constant width to its end 96 proximate the rear end 75. During insertion of the terminal into the housing cavity 10, the locking projection 30 is thus guided initially through the tapered portion into the constant width portion proximate the rear end 75 for guiding and location of the terminal with respect to the housing. The end 96 of the slot also acts as an abutment end for abutment with the projection 30 of the housing during full insertion of the terminal therein.

Referring back to FIG. 2, the top and bottom walls 80, 82 of the outer body are positioned beyond the free ends 67 of the locking lance such that the locking lance is positioned securely within the recess formed by the slot. During extraction of the terminal through the cavity 20 of the seal, the top and bottom walls of the outer body flanking the locking lance 66, thus ensure that the seal (or any other foreign object), is maintained over the free ends 67 of the locking lances to prevent obstruction therewith.

The slots 92 also provide a compact means for polarizing the terminal with respect to the cavity of the connector housing. Due to the front wall 86, the outer body provides further protection for the inner contact body and the contact section 58 of the terminal. A compact, robust and particularly reliable terminal is thus provided. The outer body 52 is mounted around the inner body and securely attached thereto by means of clinching arms 97 folded over side walls proximate the connection section 54 of the inner contact body.

Figure 6:
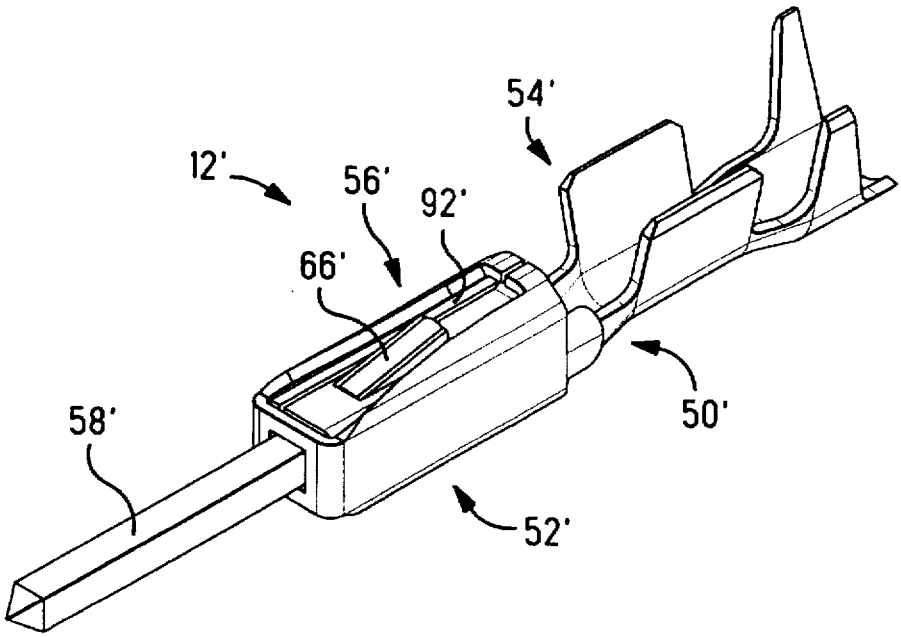
FIG. 6 is another isometric view in another direction of the male terminal of FIG. 5.

Referring now to FIG. 6, the male terminal 12' will now be described. The male terminal comprises an inner body 50' and an outer body 52'. The male terminal 12' comprises a connection section 54' for connecting to a conducting wire, a body section 56', and contact section 58'. The contact section 58' is a pin terminal assembled to the body section 56'.

The only significant difference between the design of the male and the female terminal is the contact section, otherwise there are many similar features. Locking lances 66' of the male terminal 12' extend obliquely from top and bottom walls of the box-shaped body section of the inner contact body in a similar manner to the female terminal 12. The outer body 52' is provided with axially extending slots 92' constructed in an identical manner to that already described for the female terminal 12. Insertion of the male terminal 12' in a cavity of the male connector 6, and cooperation with locking projections 30' thereof is similar to that already described for the female connector, and therefore will not be described any further.

Advantageously therefore, terminals of the connector assembly have locking lances that are well protected, in a compact configuration. The unobtrusive outer profile of the outer body also provides good protection for the terminal, in addition to providing a means for polarizing the terminal with respect to a connector housing. The smooth outer profile also enables easy insertion and extraction through a family seal of a connector. Provision of outer housings enclosing a family seal and terminal receiving housing therein, ensures a well protected and well sealed connection assembly.

We claim:

1. An electrical terminal having an inner body and an outer body, the terminal comprising a connection section for connection to a conductor, a contact section for connection to a complementary contact section of a mating terminal, and a box-shaped body section, including a body section of the inner body and a body section of the outer body surrounding the inner body section, the terminal having a resilient locking lance extending from a top wall of the inner body for locking the terminal in a cavity of a housing of a connector assembly, by engagement of the lance with a retaining shoulder of the cavity, characterized in that the outer body comprises a slot extending axially from a mating end of the body section to a position proximate the connection section, the slot forming a recess for receiving the locking lance therein such that an outwardmost free end of the locking lance is substantially at or below the outer profile of the outer body, the top wall from which the locking lance extends being positioned below an outer top wall of the outer body.

2. The terminal of claim 1 wherein the locking lance is integral with the inner body.

3. The terminal of claim 2 wherein the outer and inner bodies are separate parts stamped and formed from sheet metal.

4. The terminal of claim 1, wherein the outer body slot comprises a wide entry portion proximate the mating end that gradually narrows towards the connection section.

5. The terminal of claim 1 wherein the outer body of the terminal comprises a front wall extending across the mating end of the inner body, the front wall having a hole for allowing passage of the mating terminal therethrough.

* * * * *